United States Patent [19]

Swenson

[11] 4,240,636

[45] Dec. 23, 1980

[54] GOLF PUTTER

[76] Inventor: Ronald F. Swenson, 2719 N. Logrun Cir., Woodlands, Tex. 77380

[21] Appl. No.: 970,716

[22] Filed: Dec. 18, 1978

[51] Int. Cl.[3] ..... A63B 53/02; A63B 53/04

[52] U.S. Cl. ..... 273/169; 273/164; 273/80 A; 273/80 C

[58] Field of Search ..... 273/167 G, 169, 78, 273/80.1, 164, 80 A, 80 C, 173, 171, 172, 174; D21/217, 218, 219, 214, 215, 216

[56] References Cited

U.S. PATENT DOCUMENTS

| | | | |
|---|---|---|---|
| D. 203,512 | 1/1966 | Solheim | D21/219 |
| D. 235,893 | 7/1975 | Becker | 273/164 |
| 3,191,936 | 6/1965 | Guier | 273/80.1 X |
| 3,953,033 | 4/1976 | Kelly et al. | 273/167 G X |
| 4,136,877 | 1/1979 | Antonious | 273/164 |
| 4,141,556 | 2/1979 | Paulin | 273/167 G X |

FOREIGN PATENT DOCUMENTS

| | | | |
|---|---|---|---|
| 14812 | of 1896 | United Kingdom | 273/167 G |

*Primary Examiner*—George J. Marlo
*Attorney, Agent, or Firm*—Michael P. Breston

[57] ABSTRACT

The universal golf putter comprises a head having a center axis of symmetry and a weight of at least ten ounces. The head is characterized by a striking face, a heel and a toe extending rearwardly from the opposite sides of the striking face and a center of gravity symmetrically located behind the striking face. A curved sole rearwardly extends from the striking face and smoothly blends at the opposite ends thereof with the heel and toe. A bridge part spans between the striking face, the heel and the toe. A shank is disposed along the center axis of symmetry. A neck couples the shank with the bridge. A shaft-receiving hosel extends upwardly from the shank and angulates therewith at an angle between 10° and 20°. The hosel is coupled to a shaft terminated in a handle. The shaft has a length less than forty inches. An alignment indicator extends in a vertical plane of symmetry.

3 Claims, 10 Drawing Figures

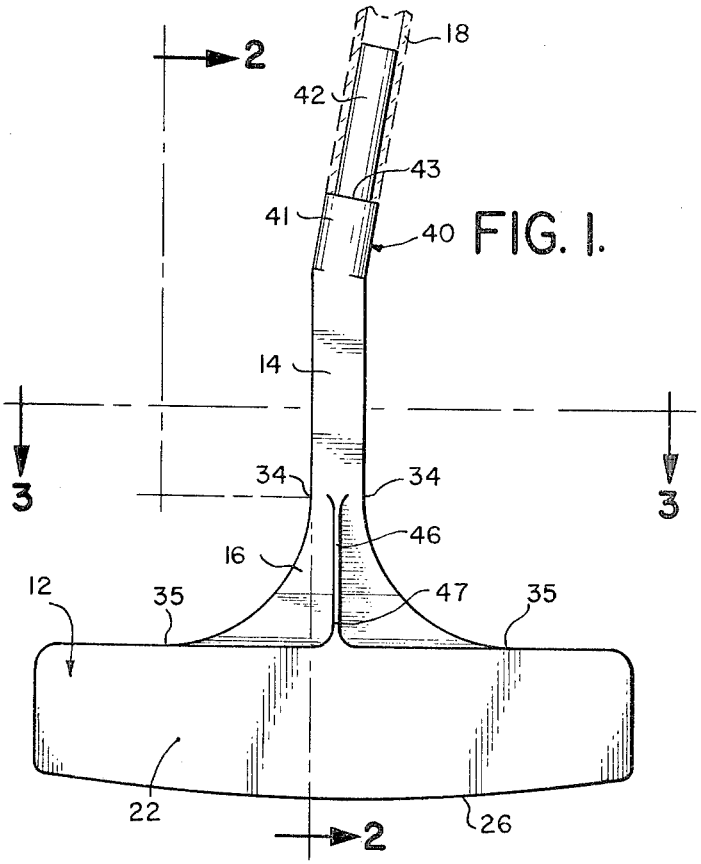
FIG. 1.
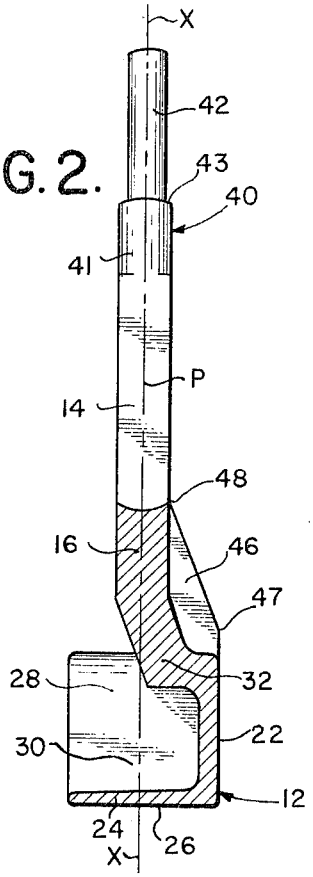
FIG. 2.
FIG. 4.
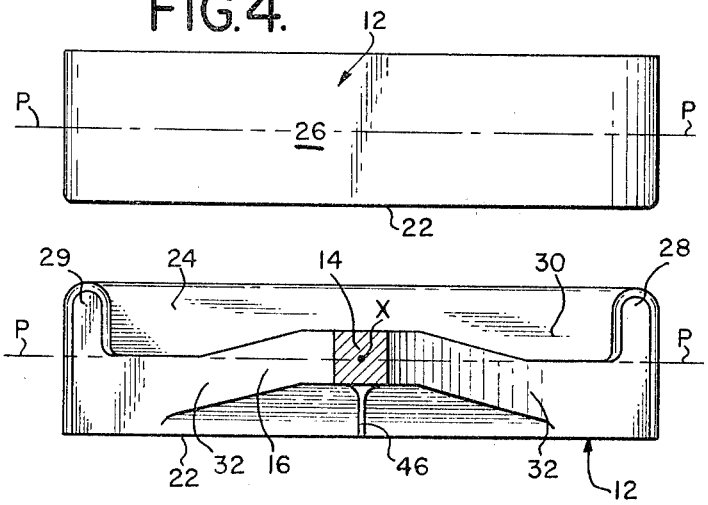
FIG. 3.
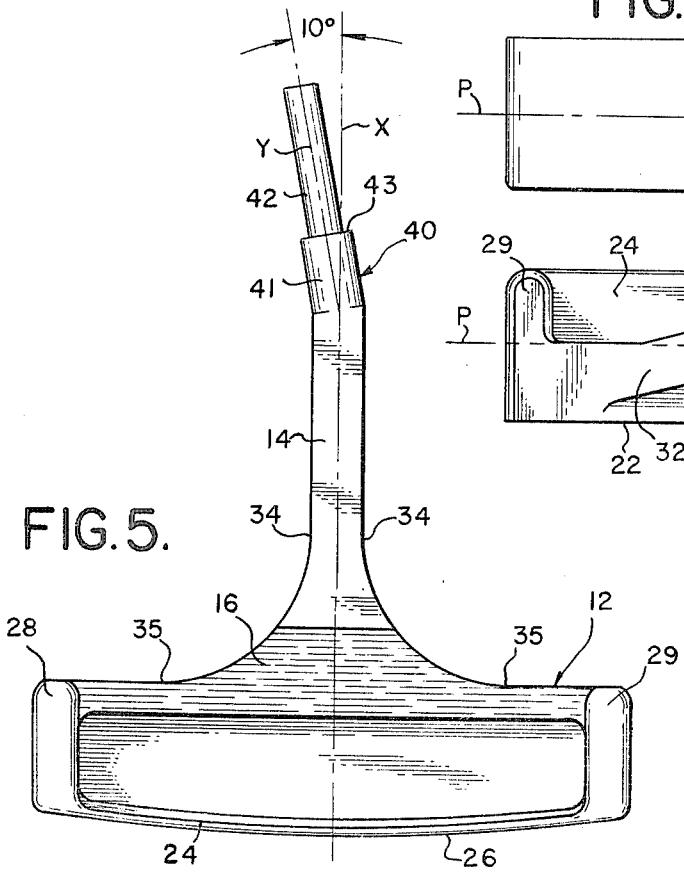
FIG. 5.

GOLF PUTTER

REFERENCE TO RELATED APPLICATION

This application is related to design patent application Ser. No. 970,715, filed on Dec. 18, 1978.

BACKGROUND OF THE INVENTION

Many types of golf putters have heretofore been developed for the purpose of improving the chances of an ordinary player to properly strike the golf ball. These developers have concentrated on improving the putter's head shape, obtaining a better balance for the head, changing the ball-striking surface, placing indicia on the head, and the like.

As examples of such golf putters, attention is directed to the following U.S. Pat. Nos. Des.: 196,734, 218,178, 234,206, 234,207, 234,208, 234,209, 234,858, 235,567, 236,517, 239,401, 239,402 and 239,725.

In U.S. Pat. No. 3,219,348 is described a golf putter featuring a handle having a triangular cross section which is supposed to provide a stablizing means for gripping the club.

In U.S. Pat. No. 3,578,332 is described a putter having an elongated head and is provided with an enlargement projecting upwardly from the top surface of the head and outwardly from the rear surface with the shaft connecting to the head at the enlargement.

In U.S. Pat. No. 3,923,308 is described a putter having a head provided with a vertical slot of sufficient width and length dimensions to permit visual observations therethrough of the undersurface, that is, the putting green.

The above-mentioned patents describe golf putters that employ conventional stances in which the player stands with his feet substantially perpendicular to the line of putt.

In U.S. Pat. No. 3,679,207 is described a different type of golf putter for use with a side putting style referred to as a "croquet style." With this putter the player must use a side stance, that is, he must face the target or cup and stand with both feet substantially parallel to the line of putt. This putter is provided with an extra-length shaft which angulates by about 10° from the vertical and terminates in a special-purpose handle. The shaft is made purposely longer than a standard shaft such that the player can putt from a generally upright position. For this purpose, the shaft is about 50 inches long compared to a standard shaft which is about 40" long. The angulation of the shaft at 10° directs the shaft towards the head of the player when the head of the putter is located to one side of the player. The putter head is weighted and a counter-balancing weight is included on the upper end of the handle. This putter requires that one player's hand be placed on the balance point along the shaft and the other hand on the handle. The putter is pivoted at the top of the handle.

As is well known, the stance or style of the player contributes significantly to his putting ability and his ultimate chances of success. This is especially true since a large percentage of all strokes in regulation golf play are putts. Moreover, putting skill is developed with relatively few available guidelines compared to the rest of the golf game, resulting in heavy dependence on the part of the player and on the physical embodiment of his preferred putter.

It is also evident that for a full understanding of the advantages of one type of putter versus another type, consideration must be given to the putting style to be employed with the particular golf putter.

Accordingly, the golf putter of this invention has been developed for both conventional putting styles as well as for use with a side putting style which is relatively simple, requires very little skill, and removes most of the uncertainty as to alignment between the ball and the target.

The primary advantage of the side putting style in accordance with this invention is ease of putting alignment. The putter is made to function as a natural extension to the arm of the player whose shoulder serves as the pivot point for both the arm and the putter: there is no relative motion between the putter and the arm and both swing in the direction of the target.

The swing of the arm and putter will be along a line which is generally parallel to the direction of the player's feet. Therefore, aligning the foot adjacent to and alongside the ball in the direction of putt prior to putting adds considerable assurance to the player. Moreover, obtaining a proper sight alignment, with the player's head in an upright position facing the putt, allows the use of both eyes for gauging the distance of the target and greatly contributes to improved depth perception.

When used with the conventional stance, the golf putter of this invention is designed to ensure that the player's head is directly over the ball, and the horizontal distance between the player's hands and line of putt is minimized, thereby reducing the tendency to pull short putts.

SUMMARY OF THE INVENTION

The universal golf putter comprises a head having a center axis of symmetry and defining a striking face, a heel and a toe extending rearwardly from the opposite sides of the striking face. A curved sole extends rearwardly from the striking face and blends smoothly with the opposite ends thereof and with the heel and toe. A bridge part spans between the striking face, the heel and toe. A shank is disposed along the center axis of symmetry. The sole is sustained by a radius drawn from a center lying on the axis of symmetry. A neck couples the shank with the bridge. The neck has a cross-sectional area which decreases from the bridge to the shank. A shaft-receiving hosel extends upwardly from the shank and a shaft is coupled thereto. The shaft's longitudinal axis angulates with the axis of symmetry of the head by an angle between 10° and 20°.

BRIEF DESCRIPTION OF THE DRAWINGS

FIG. 1 is a front view of the putter head according to the teachings of the present invention;

FIG. 2 is a view, partly in section, on line 2—2 of FIG. 1;

FIG. 3 is a view on line 3—3 of FIG. 1;

FIG. 4 is a bottom view of the putter head;

FIG. 5 is a rear view of the putter head;

DETAILED DESCRIPTION OF A PREFERRED EMBODIMENT

Figure 8:
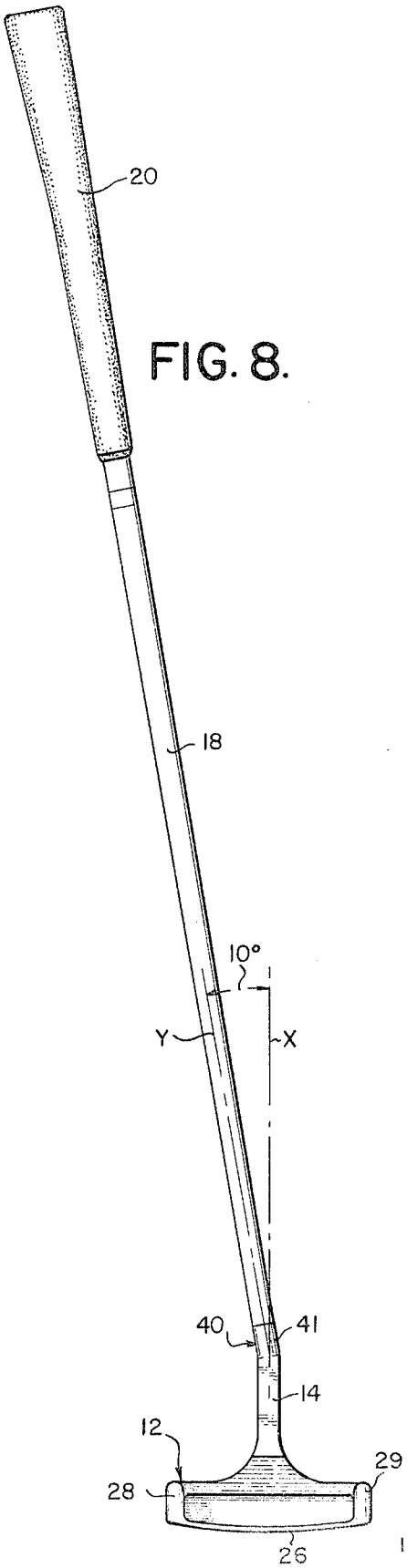
FIGS. 6–8 are front, side, and rear views, respectively, of the putter.

Referring to the drawings, and more particularly to FIGS. 1–5 thereof, there is shown a golf putter, generally designated as 10, which comprises a putter head 12, a shank 14, a neck 16 coupling the shank with the head, a hosel 40 extending vertically from and angulating with shank 14, a standard shaft 18 extending from the hosel, and a grip 20 terminating the outer end of the shaft.

Figure 7:
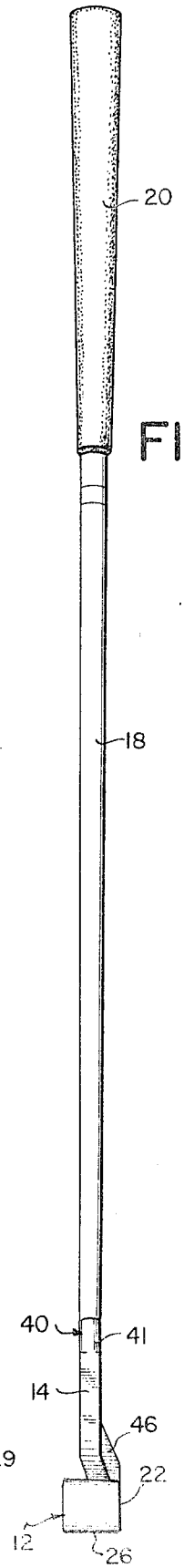
Figure 6:
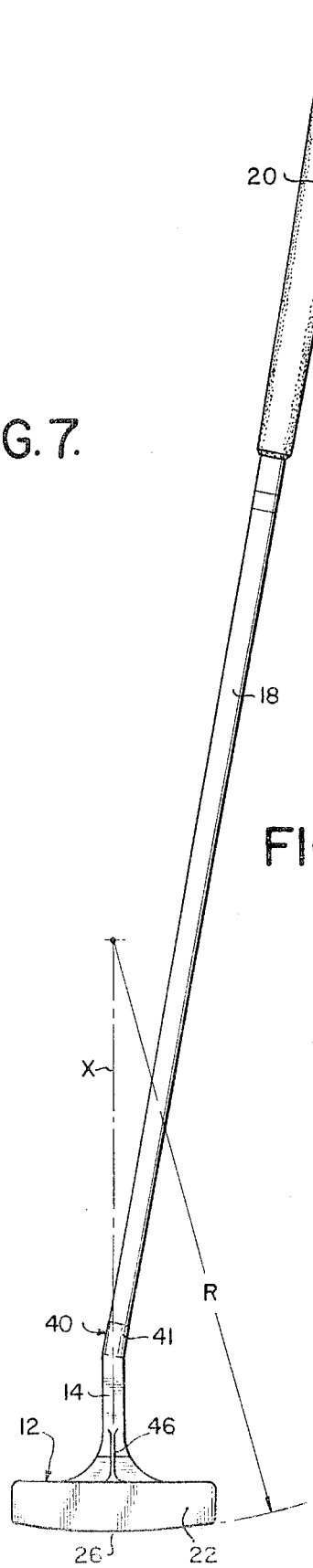

The putter head 12 has a substantially rectangular ball-striking face 22 which forms integral part with a rearwardly-extending sole, generally designated as 24. The head's sole 24 has an arcuate surface 26 which is symmetrical about the center axis X of the putter head 12. Sole 24 and striking face 22 form integral part and blend with a heel 28 and a toe 29 which extend rearwardly from face 22 and upwardly from sole 24. The curved sole face 26 blends with the heel and toe. The arc of the sole face 26 is preferably struck from a point 0 (FIG. 6) on the center line X with a radius R of about 12 inches. This rounded sole results in less drag than a flat sole in the event of surface contact. The toe and the heel have a substantially rectangular side-face, as can be best viewed from FIG. 7, the width of which is coextensive with the width of sole 24 (FIG. 2). The rear ends of the heel and toe are rounded off (FIG. 3) to streamline the overall design. The heel and the toe are identical in shape and each is relatively thicker than the striking face 22 or the sole 24 and, therefore, each embodies a substantial concentrated mass therein for reasons which will become subsequently apparent.

Between the toe, heel, striking face and sole is formed a wide recess 30 which considerably reduces the overall weight of the putter head 12. A bridge part 32 (FIG. 2) spans between the striking face, the heel and toe. The width of the bridge part 32 is about one-half or less of the width of sole 24.

Forming integral part with and extending rearwardly, vertically and symmetrically between the toe and heel is a neck 16 extending from a horizontal plane 34 to points 35 on the opposite sides of the vertical center axis X. Points 35 lie on the bridge 32 approximately midway between the vertical axis X and the end faces of the putter head.

Extending vertically upwardly from the horizontal plane 34 is shank 14 having, in the preferred embodiment, a rectangular cross-sectional area. Shank 14 and neck 16 are symmetrically disposed relative to the vertical center axis X, and both lie in or close to a longitudinal vertical plane P bisecting the putter sole 24.

Except for the shank 14 and pointer 46, the entire putter head 12 has smooth rounded corners and is streamlined in design. The weight of the head is distributed such that the center of gravity of the head is centrally located behind the striking face 22.

Extending upwardly from shank 14 is a hosel part 40 having a bottom cylindrical portion 41 and an upper cylindrical portion 42 of reduced diameter compared to the diameter of portion 41 whereby an annular shoulder 43 is formed therebetween. The axis Y (FIG. 5) of hosel 40 forms an angle between 10° and 20°. The preferred angle is about 10° with the vertical center axis X.

The conventional straight shaft 18 has a bore at the inner end thereof which receives the reduced diameter hosel part 42 and is securely cemented thereto. The outer diameter of shaft 18 is preferably the same as the outer diameter of the hosel part 41, thereby providing a smooth transition therebetween. The outer end of shaft 18 is terminated by a conventional grip 20. Thus, the axis Y (FIG. 5) is also the longitudinal axis of shaft 18.

An alignment indicator 46 (FIG. 2) extends in a transverse vertical plane containing the midpoint 47 on the upper edge of the striking face 22 and a point 48 (FIG. 1) near the junction between the shank 14 and the neck 16. Thus, alignment indicator 46 lies in a plane containing the center axis X.

APPLICATION OF THE UNIVERSAL PUTTER 10

Figure 9:
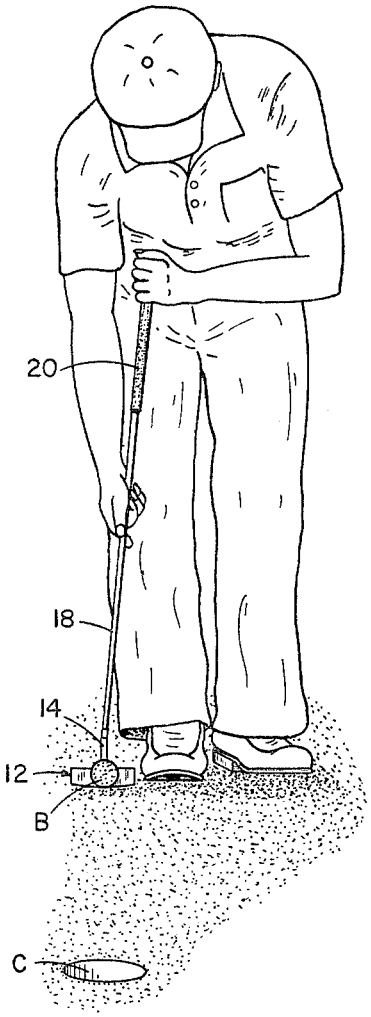
FIG. 9 illustrates the use of the putter of the invention with a side putting stance.
Figure 10:
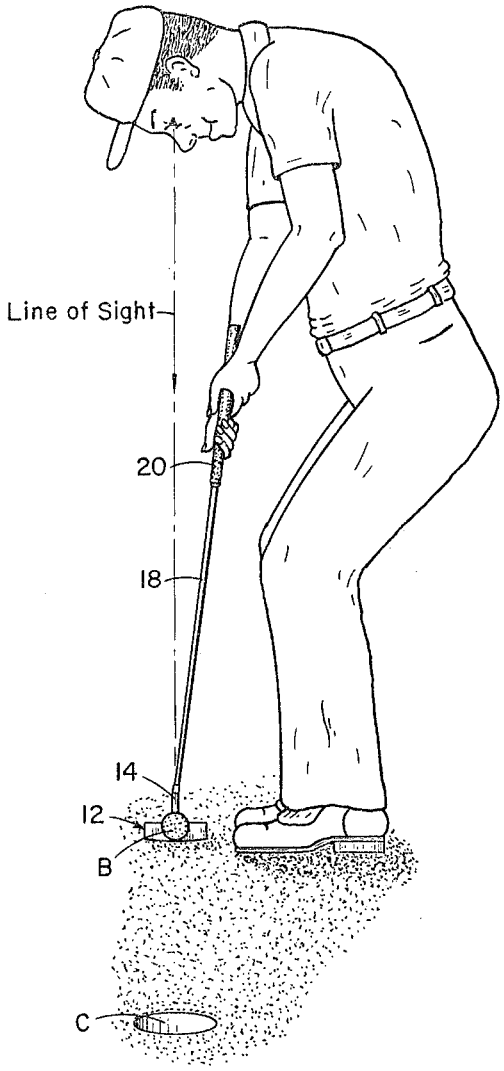
FIG. 10 illustrates the use of the putter of the present invention with a conventional putting stance.

When employing the golf putter 10 of the present invention, the player can assume a basic conventional stance, as shown in FIG. 10, or a basic side stance, as shown in FIG. 9, or a combination of these two basic stances. The golf putter 10 of the present invention allows for maximum latitude on the part of the player when putting. FIGS. 9 and 10 illustrate only the two basic stances for right-handed players.

For the side putting stance with the golf putter 10 of the present invention, the player assumes a position as shown in FIG. 9. This stance is illustrated for a right-handed player. The right foot of the player is located adjacent to or slightly in front of the left foot. The right foot is set pointing in the direction of the putt C, about ten inches in back of and about six inches to the left of the ball B. The left foot is positioned adjacent to or slightly behind the right foot.

The putter 10 is then properly positioned and the striking face 22 is aligned so that the alignment indicator 46 contains the line of sight. The player is then in condition to strike ball B. As a variation of the above-described stance, the left foot is located in front of the right foot with the remaining steps being substantially the same. When using this alternate stance, the hips will pivot slightly depending on the spread between the player's right and left feet. It should be remembered that the U.S.G.A. rules prohibit standing astride or having either foot on the line of putt.

When holding shaft 18 for putting, the left hand (for right-handed players) is placed at the top of grip 20 and the right hand is located at any point along the shaft. The selected position should feel comfortable to the player.

When stroking the putt, the hands will coordinate as the putter moves: the left hand will move in the same direction as and in coordination with the right hand during the putting stroke. Moving both hands together in a backward and forward motion is important; the top hand should not be held stationary and used as a pivot point. Of course, the backstroke will be proportional to the length of the putt: the longer the putt, the longer the backstroke.

The forward stroke must be accelerated such that the putter head fairly strikes the ball B as opposed to pushing. The speed of the putter stroke is related to the length of putt, incline of putting green, speed of putt, etc., which is based on the player's prior experience.

The putter of the present invention can also be used in the conventional style as shown in FIG. 10. When used in the conventional manner or any of the various conventional putting stances, the golf putter 10 of the present invention is designed to ensure that the player's head will be located directly over the ball. The 10° angle between axis Y of hosel 40 and the vertical axis X minimize the distance between the player's hands on grip 20 and the line of putt between the ball B and cup C. This minimum distance reduces the tendency to pull short putts when putting in a conventional manner.

Among the advantages of the construction of the universal putter of the present invention, it will be appreciated that the striking face 22 is continuous and flat which provides an extended striking area for the ball. The recess 30 in back of the striking face reduces the weight and increases the "feel" when putting. The "sweet spot" is considerably enlarged by the symmetrical design of putter 10 about the vertical center-line X, by a concentrated mass at the heel and at the toe, and by the neck 16 having a spreadout base that smoothly blends into and forms integral part with the bridge part 32 of the head 12.

In the preferred embodiment, the head 12 has a width of 4 inches, a height of 1 inch, the distance from the center point of the sole to the point of intersection between axes X and Y is about 3.5 inches. The weight of the head is balanced relative to the center axis X. There is a point along the shaft from which the putter can be held whereat the sole will remain parallel to the horizontal. This point is known as the balance point, and the right hand will naturally be positioned at or near that balance point (FIG. 9) when gripping the shaft. This balance point is usually attained along the shaft generally at a point approximately two-thirds of the length of the shaft from the end of the grip.

The length of the shaft is preferably about 35 inches which allows it to be used, in most cases, as an extension of the player's arm when stroking the putt. The shaft's length should preferably be less than forty inches. The putter of this invention allows precision for short putts, as well as good depth perception and alignment for long putts. This versatility of putter 10 enhances the player's putting confidence.

The head 12 is made of a metallic material such as sodium bronze. It has been found that the preferred weight of the head should be at least ten ounces but not more than fifteen ounces.

Since the neck 16 lies in or close to a plane bisecting the sole 24, the head is balanced relative thereto and also centrally locates the alignment indicator 46. In this manner, the alignment indicator does not project outwardly of the striking face.

The concentrated mass at the toe and the heel of the head allow the player to hit the ball at any point along the striking face, and still maintain putting accuracy.

What is claimed is:

1. A golf putter head having a center axis of symmetry, said head defining a ball-striking face; a heel and a toe extending rearwardly from the opposite sides of the striking face; a sole having a curved surface extending rearwardly from the striking face and forming integral part with the heel and toe; a bridge part spanning between the striking face, the heel and the toe, said toe and said heel being weighted, whereby the center of gravity of said putter is substantially symmetrically located behind said striking face; a shank extending upwardly and being disposed along said center axis; a neck coupling said shank with said bridge part; a shaft-receiving hosel extending upwardly from said shank; said striking face, sole, heel and toe form an open recess therebetween and said recess extends over the majority surface of said striking face; and said striking face being integral and continuous with said sole and said bridge part.

2. A golf putter head having a center axis of symmetry, said head defining a ball-striking face; a heel and toe extending rearwardly from the opposite sides of the striking face, said toe and said heel being weighted whereby the center of gravity of said head is symmetrically located behind said striking face; a sole having a curved surface extending rearwardly from the striking face and forming integral part with the heel and toe; a bridge part spanning between the striking face, the heel and the toe; a shank extending upwardly and being disposed along said center axis; a neck coupling said shank with said bridge part; a shaft-receiving hosel extending upwardly from said shank; a shaft coupled to said hosel and said shaft having a longitudinal axis intersecting said center axis at a point above said shank and said axes forming therebetween an angle of at least 10°.

3. A golf putter head having a center axis of symmetry, said head defining a ball-striking face; a heel and a toe extending rearwardly from the opposite sides of the striking face, said toe and said heel being weighted whereby the center of gravity is symmetrically located behind said striking face; a sole having a curved surface extending rearwardly from the striking face and forming integral part with the heel and toe, said striking face, sole, heel and toe forming an open recess therebetween and said recess extending over most of the surface of said striking face; a bridge part spanning between the striking face, the heel and the toe, and said striking face being integral and continuous with said sole and said bridge part; a shank extending upwardly and being disposed in a substantially longitudinal plane which bisects said sole; a neck coupling said shank with said bridge part; said neck having a cross-sectional area which decreases gradually from said bridge part and blends smoothly with said shank; a shaft-receiving hozzle extending upwardly from said shank; and a shaft coupled to said hozzle, the longitudinal axis of said shaft intersecting said center axis at a point above said shank and forming an acute angle therewith.

* * * * *